US006257345B1

(12) United States Patent
Tozer

(10) Patent No.: US 6,257,345 B1
(45) **Date of Patent: *Jul. 10, 2001**

(54) DEVICE FOR COLLECTION OF DEBRIS

(75) Inventor: Warwick Brook Tozer, Eltham (AU)

(73) Assignee: Aero-Tech Pty Ltd, Nunawading (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/331,983

(22) PCT Filed: Jan. 2, 1998

(86) PCT No.: PCT/AU98/00001

§ 371 Date: Aug. 17, 1999

§ 102(e) Date: Aug. 17, 1999

(87) PCT Pub. No.: WO98/29609

PCT Pub. Date: Jul. 9, 1998

(30) Foreign Application Priority Data

Jan. 3, 1997 (AU) ..... PO-4437

(51) Int. Cl.[7] ..... E01H 1/00

(52) U.S. Cl. ..... 172/199; 172/29; 172/612

(58) Field of Search ..... 56/328.1, 344; 171/63, 105, 141, 144; 172/29, 189, 197, 198, 199, 445.1, 612, 684.5

(56) References Cited

U.S. PATENT DOCUMENTS

| | | | | |
|---|---|---|---|---|
| 1,997,248 | * | 4/1935 | Densberger | 172/612 |
| 5,018,587 | * | 5/1991 | Gandrud et al. | 172/612 |
| 5,284,211 | * | 2/1994 | Tozer | 172/29 |
| 5,918,684 | * | 7/1999 | Tozer | 172/199 |

* cited by examiner

*Primary Examiner*—Robert E. Pezzuto
(74) *Attorney, Agent, or Firm*—Seed IP Law Group PLLC

(57) ABSTRACT

A device (300) for collecting debris from a surface. The device has a generally planar matting material (15) the undersurface of which is formed with depending bristles (14). The device (300) has an opening (16) therethrough which when the device is moved over a ground surface (18) with the bristles (14) in contact therewith debris on the ground surface (18) pass through the opening (16). The forward and aft edges (361, 362) of the matting (15) are provided with transverse stiffening members (363). A plurality of wheels (365) at least partially support the stiffening members (361, 362).

41 Claims, 9 Drawing Sheets

DEVICE FOR COLLECTION OF DEBRIS

FIELD OF THE INVENTION

This invention relates to a device for collection of debris.

BACKGROUND ART

U.S. Pat. No. 5,284,211 discloses a ground surface debris collection device suitable, for example, for collecting small debris such as leaves from a ground surface. This comprises a device of flexible grid like construction having slots so that, as the device is moved over the ground surface, debris passes through the slots and onto the upper surface of the device.

While the arrangement shown in Pat. No. 5,284,211 has been found to be very satisfactory in use, particularly for grooming and cleaning tennis court surfaces, it has now been found it is not efficient as is desirable on rougher surfaces such as rough asphalt.

International Patent Application WO96/09440 discloses a device suitable for efficiently collecting debris from a variety of surfaces. The device has a generally planar matting the undersurface of which is formed with depending bristles. An opening is provided whereby when the device is moved across a ground surface with the bristles in contact therewith, debris on the ground surface are passed through the opening to rest on the matting.

The device described in International Patent Application WO96/09440 has been found to be particularly useful. It would be desirable to improve its operating characteristics and extend the life of the planar matting.

DISCLOSURE OF THE INVENTION

In one aspect, the invention provides a device for collecting debris from a surface, comprising a generally planar member having at least a portion thereof defining an undersurface of the device formed of a conformable material such that when the device is moved over a ground surface with the undersurface in contact with the ground surface the undersurface is caused to locally conform to undulations in the ground surface, the device having an opening, whereby, under said movement over a ground surface, debris on the ground surface passes through the opening onto an upper surface of the device wherein said generally planar member has forward and aft edges corresponding to the direction the device is moved over the ground surface, said edges being provided with stiffening members extending transversely to the direction the device is moved over the ground surface and said stiffening members being at least partially supported by a plurality of wheels disposed for contact with the ground surface. The opening may be formed in or adjacent the conformable material.

The aforementioned portion may be formed from a flexible layer, such as of foam plastics material, or an open mat of sinuous fibres, such as open looped fibres. In a preferred form, however, the conformable material comprises a brush-like structure. The planar member may include a backing portion which may be flexible or may be relatively rigid.

Preferably, the stiffening members are transversely extending aluminium bars secured to the conformable material. In some applications plastics stiffening members can be used.

The stiffening members may be stitched, glued or otherwise securely fixed to the conformable material. In one preferred form the edge of the conformable material is formed into a hem through which the stiffening member extends.

In another aspect, the invention provides a device for collecting debris from a surface, comprising a generally planar member having at least a portion thereof defining an undersurface of the device formed with depending bristles thereover and the device having an opening therethrough whereby when the device is moved over a ground surface with the bristles in contact therewith debris on the ground surface is passed through the opening to an upper surface of the device wherein said generally planar member has forward and aft edges corresponding to the direction the device is moved over the ground surface, said edges being provided with stiffening members extending transversely to the direction the device is moved over the ground surface and said stiffening members being at least partially supported by a plurality of wheels disposed for contact with the ground surface.

The opening may have at a rear edge thereof a forwardly and downwardly depending surface to facilitate pick up of debris. Also, to assist in retention of debris on the device, the device may be fitted at its upper surface with upstanding projections ridges or the like. For example, an upstanding wall may be formed along the front edge of the opening and/or at one or both side edges of the opening.

There may be a single opening, but it is preferred that there are a number of openings.

In a still further aspect, the invention provides a device for collecting debris from a surface, comprising a generally planar member having an opening through the generally planar member whereby, under said movement over a ground surface, debris on the ground surface passes through the opening onto an upper surface of the device, the device having means for entrapping debris having passed through the opening wherein said generally planar member has forward and aft edges corresponding to the direction the device is moved over the ground surface, said edges being provided with stiffening members extending transversely to the direction the device is moved over the ground surface and said stiffening members being at least partially supported by a plurality of wheels disposed for contact with the ground surface. The entrapping means may comprise a mesh material. The material forming the entrapping means may comprise material which forms a cavity over the upper surface of the generally planar member. Otherwise, the device may for example be constructed as above described. Alternatively, it may be for example be constructed in accordance with the teachings of the abovementioned U.S. Pat. No. 5,284,211, the disclosures of which are hereby incorporated to form part of the present specification.

In each aspect of the invention the wheels are preferably spaced along the stiffening members. Preferably, the wheels are disposed forward and aft of at least one of the stiffening members. In one form of the invention at least some of the wheels are arranged in pairs with one wheel of the pair forward and the other aft of the stiffening member and aligned in the direction the device is moved. The wheels preferably protrude through the planar member to contact the ground surface. In the currently preferred embodiment of the invention the stiffening member has wheels disposed only on the aft side. The wheels preferably have a diameter not substantially greater than the thickness of the planar material.

The invention is further described by way of example only with reference to the companying drawings.

BEST MODES FOR CARRYING OUT THE INVENTION

Figure 1:
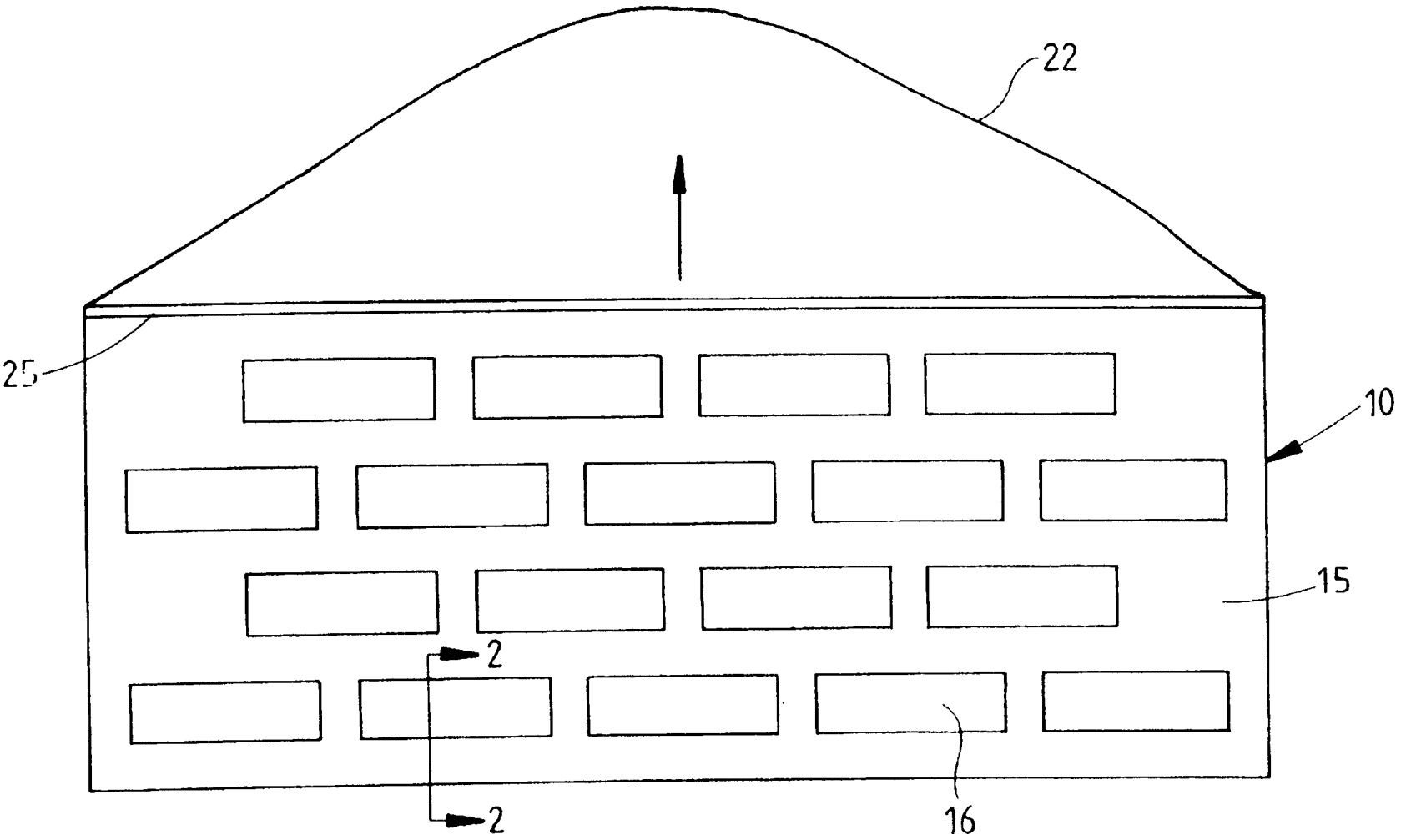
FIG. 1 is a plan view of device constructed in accordance with the invention.
Figure 2:
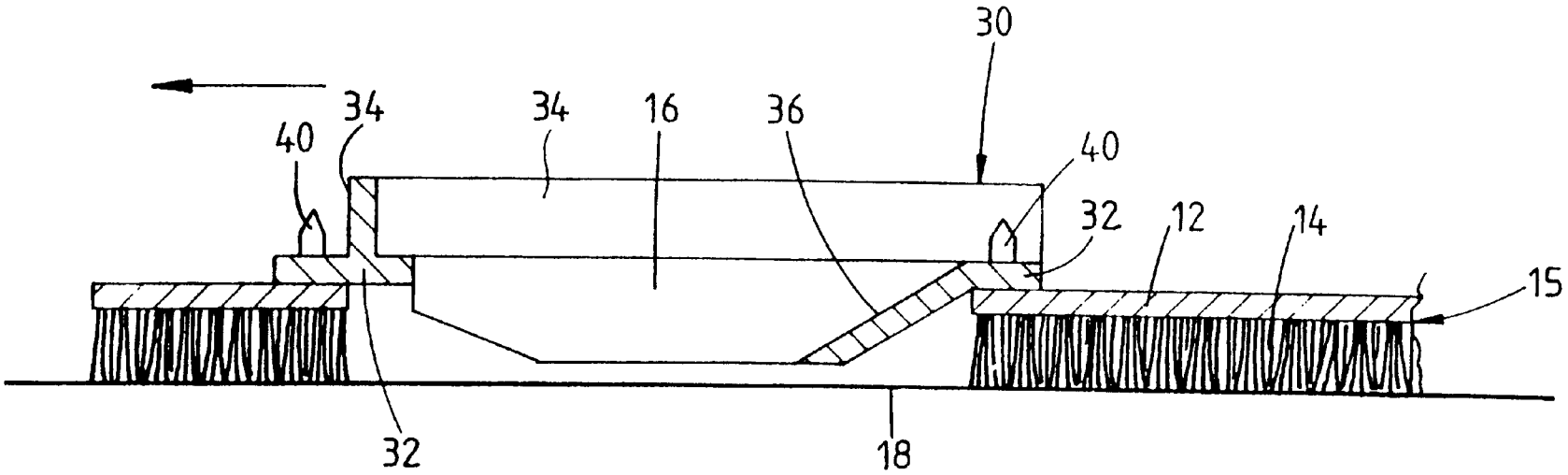
FIG. 2 is an enlarged cross-section on the line 2—2 in FIG. 1.
Figure 3:
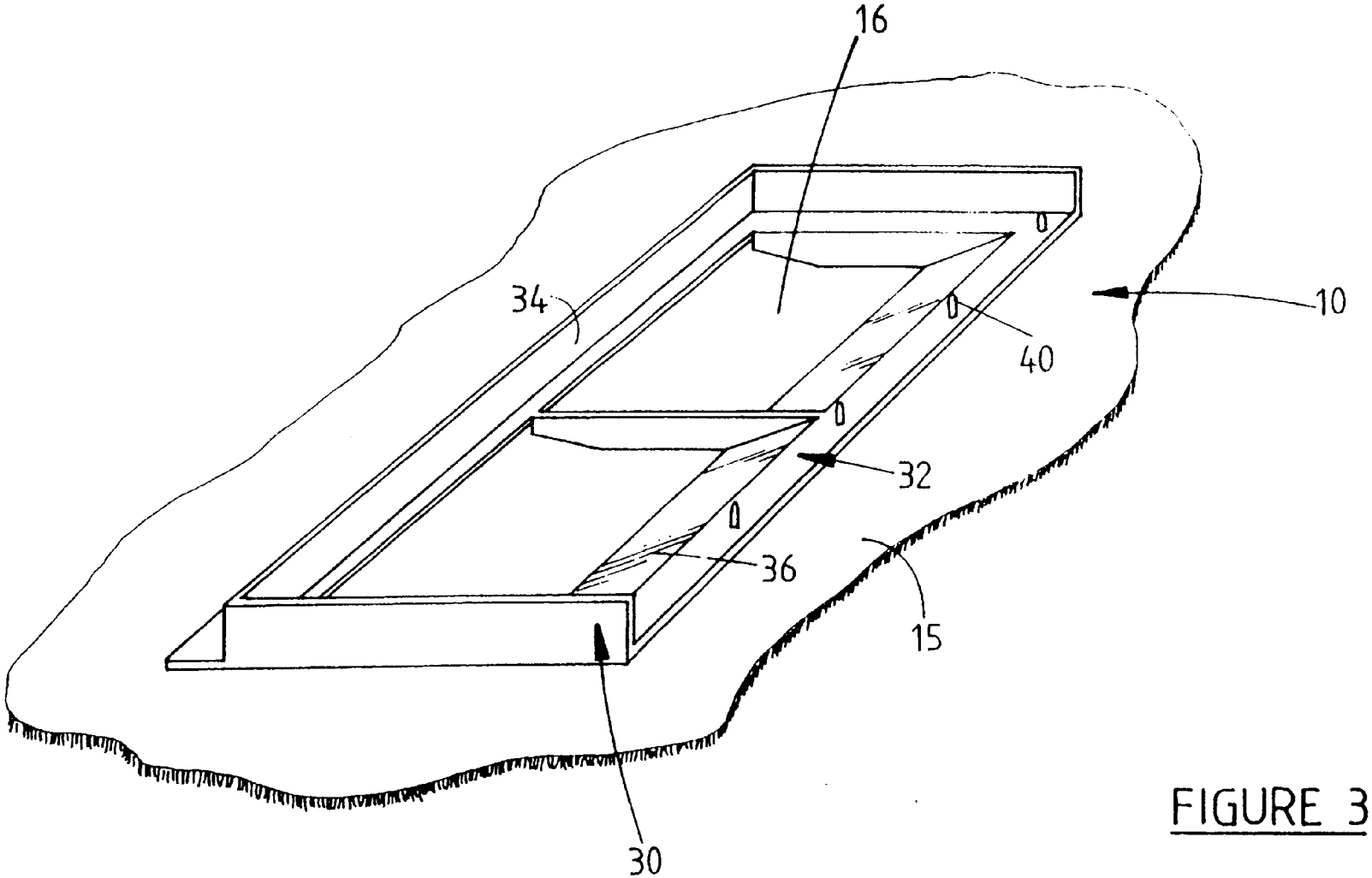
FIG. 3 is an enlarged perspective view of a reinforcing frame incorporated into the device of FIG. 1.

Referring firstly to FIGS. 1, 2 and 3, the device 10 shown therein is formed of a conformable matting material 15 having, as shown in FIG. 2, a flexible laminar base portion 12 with depending bristles 14. It has been found convenient to form the device from inverted artificial grass material of the kind used for the surfaces of tennis courts and the like, arranged with the bristles extending downwardly. Generally, the material 15 should be flexible.

The matting material 15 has a series of rectangular sidewardly elongate openings 16, arranged in traverse extending spaced rows. When the device 10 is moved over a ground surface 18 (FIG. 2), such as by towing by use of the rope 22 (FIG. 1) at a forward end thereof, the bristles 14 agitate leaves, stones and the like on the ground surface by contact therewith and this debris tends to pass from the underside of the device 10 through the openings 16 to rest on upper portions of the device 10 and on the base portion 12, between the openings 16. The debris so resting on the upper side of the device 10 can be then conveniently taken away on the device for disposal as desired. The bristles act to "flick" material into the openings 16.

In the particular form shown in FIGS. 2 and 3, each opening 16 is surrounded by a reinforcing frame 30. The frame has a peripheral edge portion 32 which at front and side portions of the opening 16 is formed with an upstanding wall 34. At the rear edge, the frame is formed with a downwardly angled edge pickup portion 36 which extends from a location at the upper side of the matting material 15 forwardly and downwardly to terminate at a location which in use of the device 10 is only just above the ground surface 18. The frame is secured in position on the matting material 15 by use of bolts or other fixture elements 40, which extend through the frame and the matting material 15. Alternatively, the frame may be stitched to the matting material.

Figure 4:
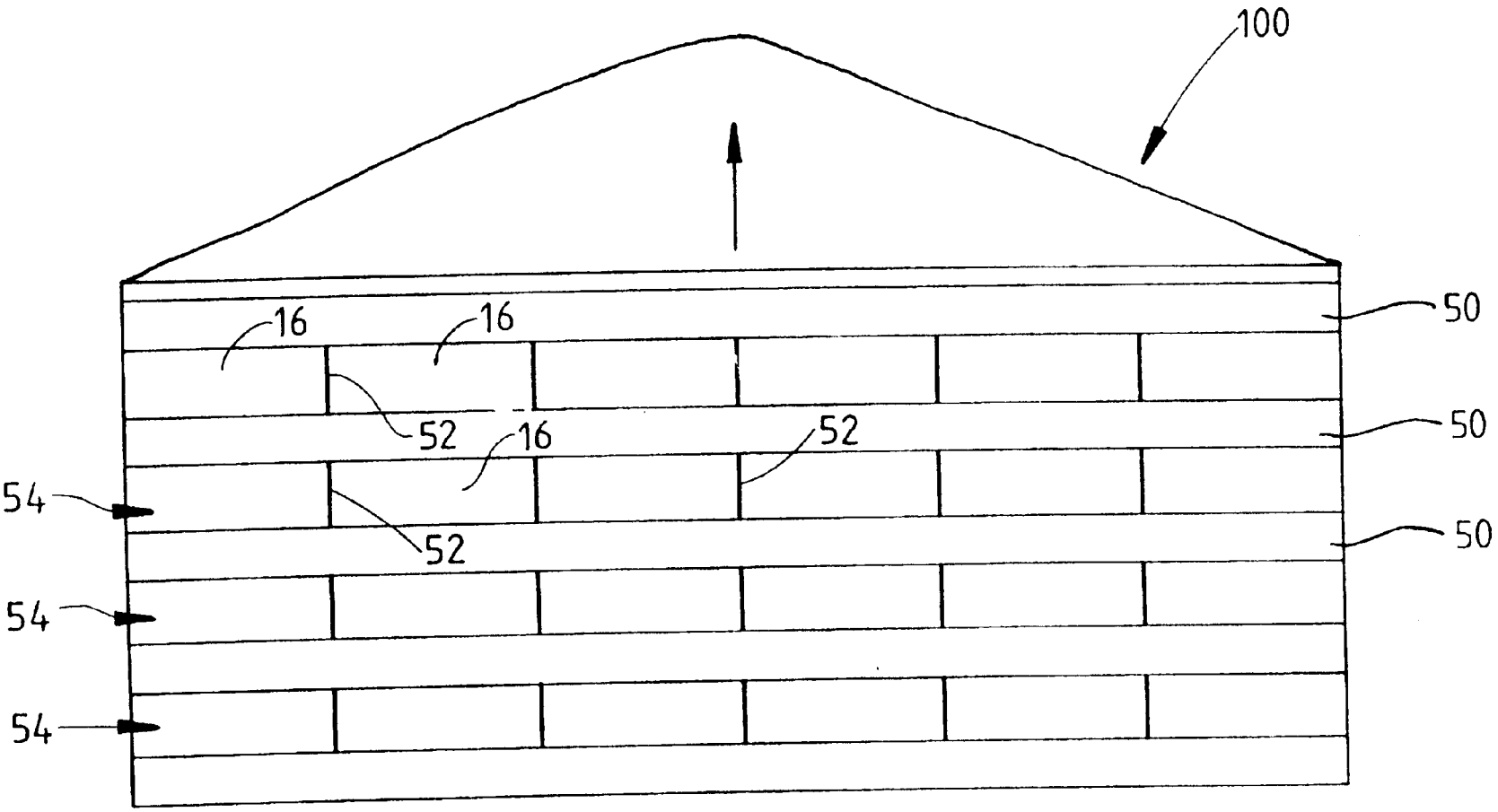
FIGS. 4 and 5 are plan views of two further embodiments of the invention.

In device 100 of FIG. 4, the openings 16 are formed between side to side extending strips 50 of matting material 15 with relatively narrow forward to rearwardly extending connector elements 52 interconnecting the strips. Thus, each set of side by side aligned openings forms a substantially continuous side to side aperture 54.

Figure 5:
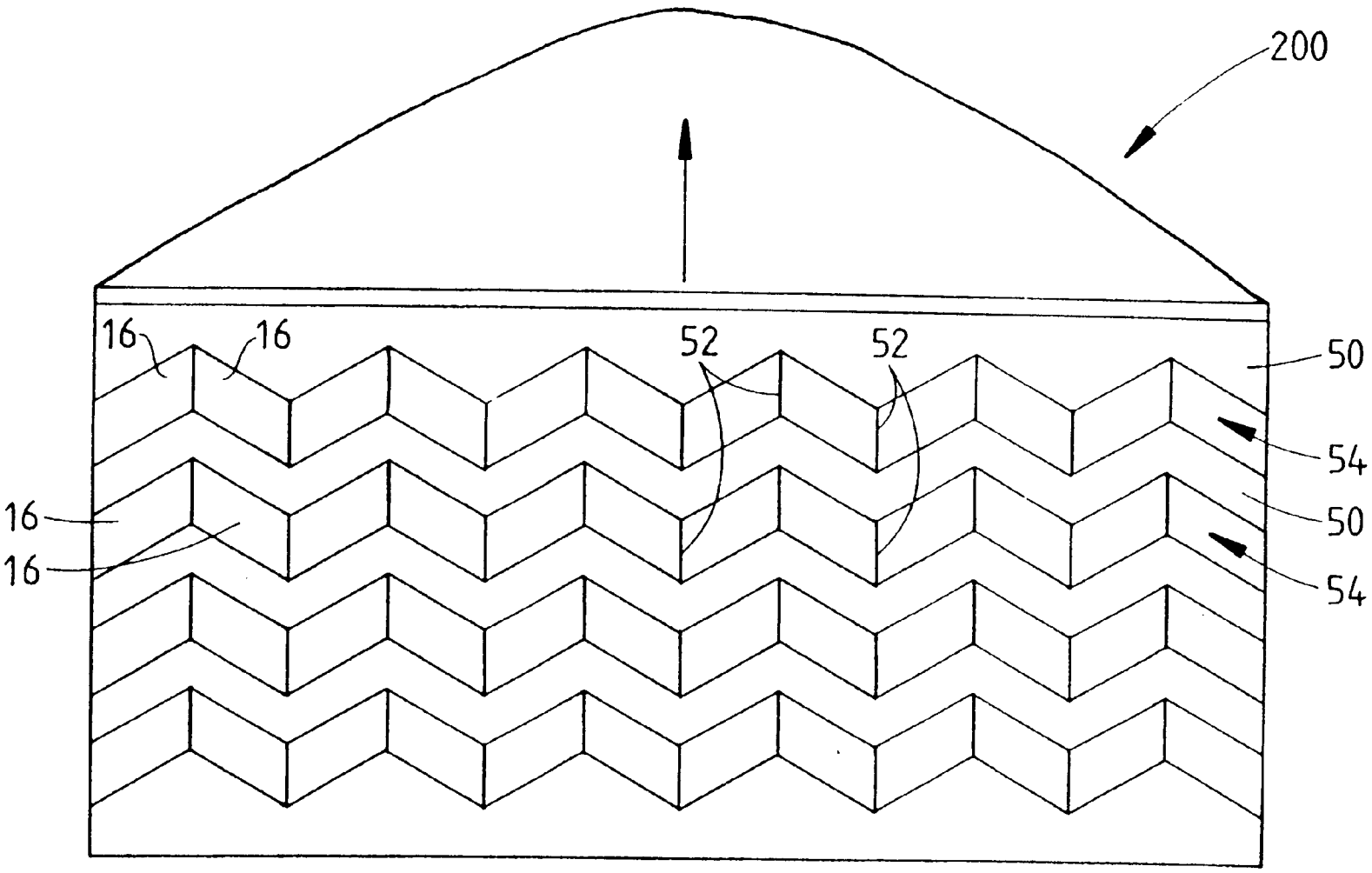

The device 200 of FIG. 5 is generally similar to that of FIG. 4, save that the side to side extending apertures 54 are of "saw tooth" configuration. Alternate openings 16 in each side to side extending aperture 54 are angled forwardly and rearwardly as shown.

Figure 6:
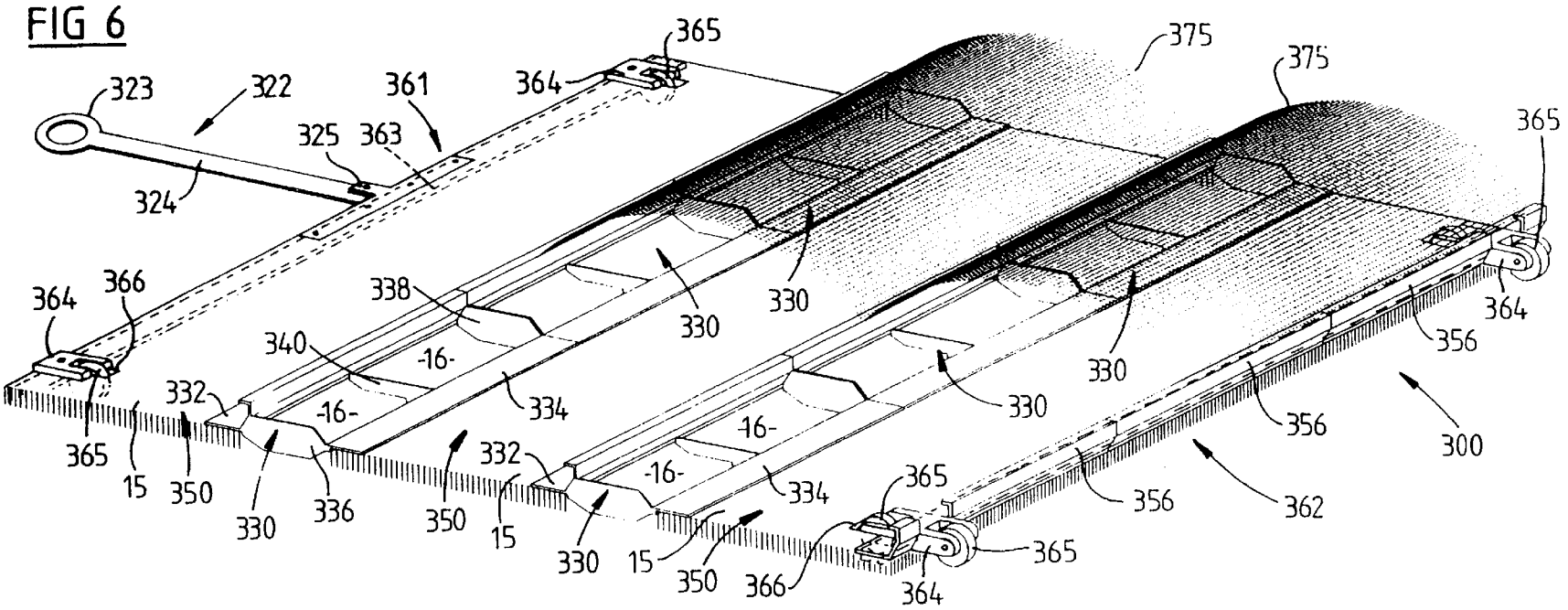
FIG. 6 is a perspective view of another embodiment of the invention.
Figure 7:
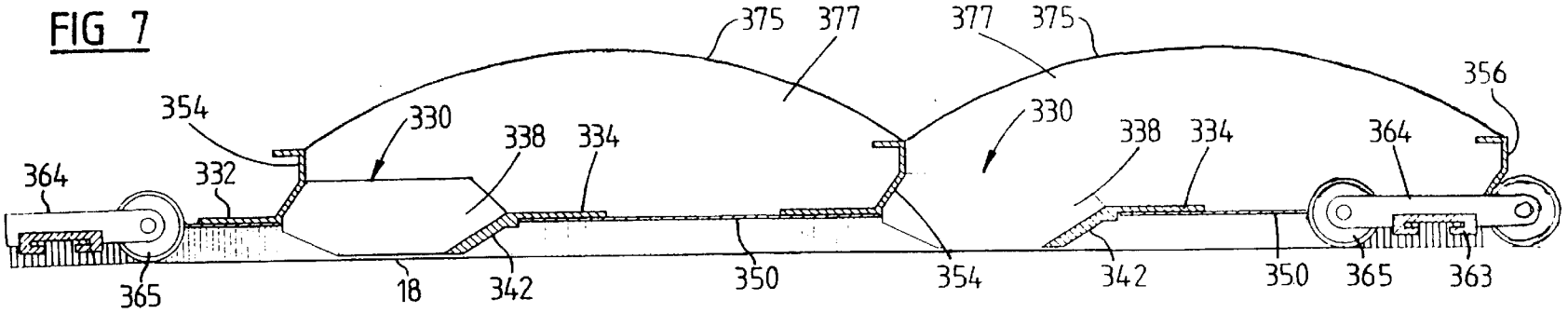
FIG. 7 is a side to side cross-section of the embodiment of FIG. 6.
Figure 7A:
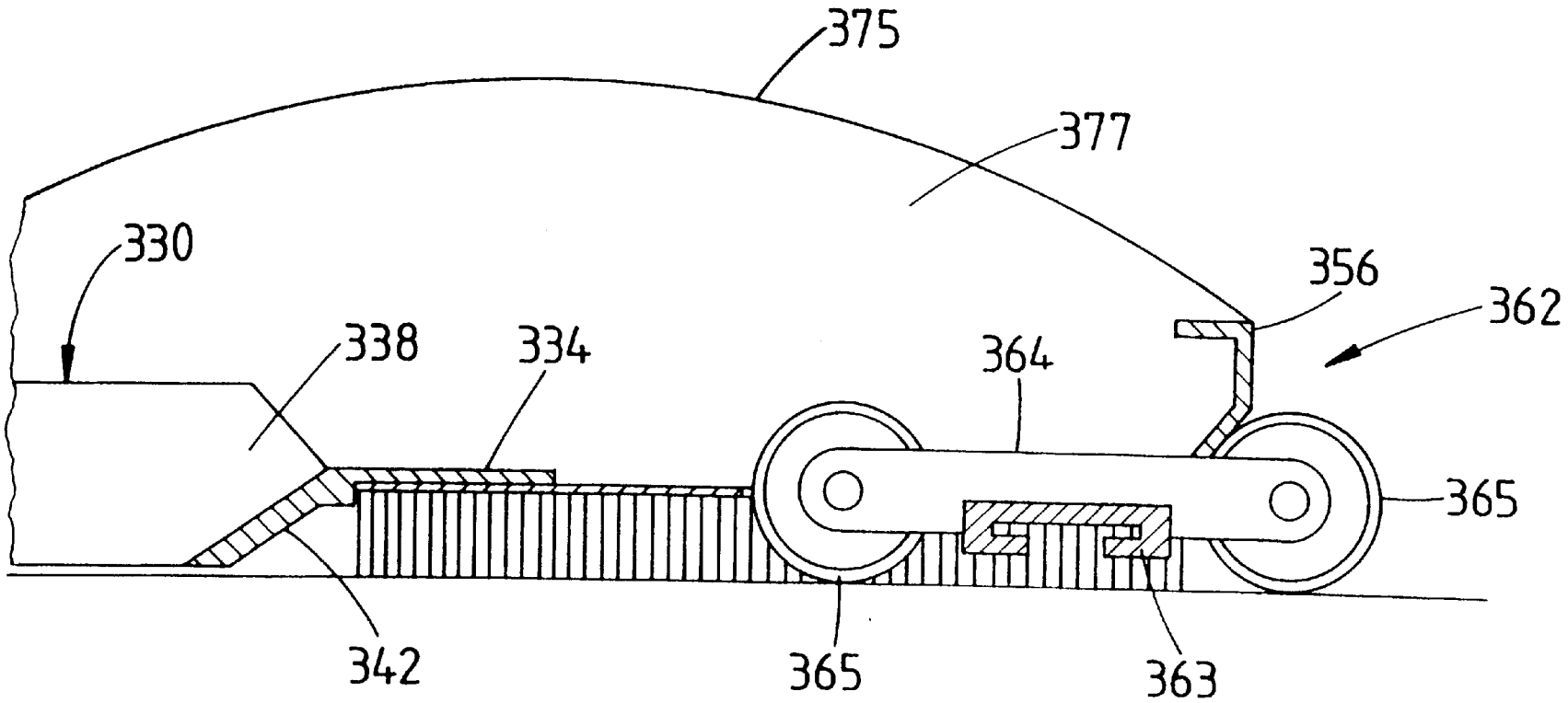
FIG. 7*a* is an enlarged view of part of the cross-section shown in FIG. 7.
Figure 12:
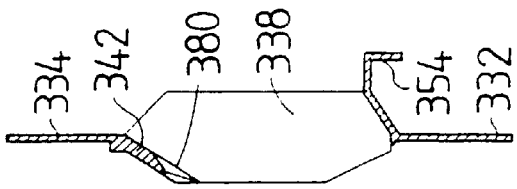
FIGS. 11 and 12 are respective cross sections on the lines 11—11 and 12—12 in FIG. 8.
Figure 11:
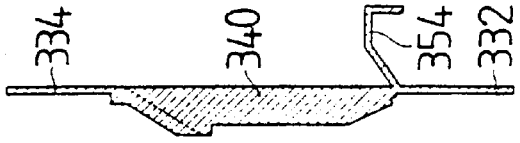

The device 300 of FIGS. 6, 7 and 7*a* has side to side extending strips 350 formed from matting material 15 and interconnected by plastics frames 330. In this case there are three strips 350 interconnected by two sets of the frames 330, with each set of frames comprising three sidewardly aligned frames. Each frame 330 comprises a forward generally planar horizontally extending portion 332 and a rear planar generally horizontally extending portion 334, co-planar with portion 332. Portion 332, 334 are connected at ends of each frame 330 by end walls 336, 338 and by an intermediate wall 340. Walls 330, 338, 340 are generally planar and vertically extending, and of relatively small thickness in the side to side direction of the device 300, so that each frame presents two relatively large side by side openings 16.

The three front frames 330 in each set are in closely adjacent side by side relationship so as to provide, across the width of the device 10, six openings 16. Each portion 334 has a forwardly and downwardly inclined pick-up portion 342 which extends downwardly to a location adjacent to ground surface 18 (FIG. 7). This functions in a similar manner to the downwardly angled pick-up portion 36 previously described.

At the rear of each frame portion 332, there is an upwardly extending wall portion 354, these being arranged, for each set of frames, so as to present a substantially continuous wall extending from side to side of the device 300.

Three end pieces 356 are provided in end to end abutting relationship across the width of the device 10 at the rear edge of the rear one of the three strips 350. These define an upstanding side to side extending wall similarly configured to the walls provided by the side to side wall portions 354 associated with the two frames 330.

Forward edge 361 and aft edge 362 of matting material 15 are provided with transversely extending aluminium stiffening members 363. The stiffening members 363 may be affixed to the matting material 15 by stitching or gluing. Alternatively a hem may be formed at the edge of the material 15 by folding it back upon itself or securing the edge by glueing or stitching. In this arrangement the stiffening member is retained in the hem.

Wheel carriers 364 are fixed to the members 363 by bolts or other fasteners. The carriers 364 adjacent forward edge 361 each mount a single wheel 365 which depend through holes 366 to contact the ground surface. Carriers 364 adjacent aft edge 362 mount pairs of wheels 365 forward and aft of the stiffening member. These wheels are aligned in the direction of movement of the device. The forward wheels 365 depend through holes 366 to contact the ground whilst aft wheels 365 are mounted to contact the ground behind aft edge 362.

In use stiffening members 363 provide sufficient transverse rigidity in the forward and aft edges of the device to facilitate handling, in particular, during removal of collected debris as described below. The wheels 365 support the stiffening members to prevent excessive wear of the matting material adjacent the stiffening members. Only a single set of wheels 365 is generally required at the forward edge 361 because the towing hitch, usually connected to the stiffening member, provides some support. In some applications however wheels forward and aft of the stiffening member may also be used at the forward edge. The wheels 365 have a diameter not substantially greater than the thickness of matting material 15.

The wheels 365 have also been found to improve the longitudinal stability of the device 300. In particular the wheels 365 provide a degree of resistance to transverse movement of the device during use. That is, the wheels 365 cause the device 300 to track a towing vehicle (not shown). This has been found to improve the cornering characteristics of the device 300 since the tendency to slide is reduced and also to reduce any sideways movement when moving at relatively high speed.

The device 300 incorporates a solid towing hitch 322. The hitch 322 has a connecting ring 323 rigidly fixed to a bar 324. Bar 324 is pivotally connected to stiffening member 363 at 325. The pivotal connection 325 preferably allows movement of bar 324 only in a horizontal plane. In this way the solid towing hitch 322 can be used to provide some support for the stiffening member 363 as described above.

Fine mesh screens 375 having some flexibility and resilience, are positioned so as to extend from side to side of the device 300, the forward one of these extending from the upper edges of the wall portions 354 associated with the three forward frames 330 in an upwardly arched configuration to corresponding locations at the wall portion 354 associated with the rearwardly positioned frames 330. Similarly, the rear screen 375 extends in upwardly arched configuration from the upper edge of the wall portions 354 of the rearwardly disposed frames 330 to the upper edges of the end pieces 356. These screens 375 thus define substantially a closed spaces 377 above the forwardly positioned openings 16 and the following strip 350 and above the rearwardly disposed openings 16 and the following strip 350. If desired, these spaces may be closed at the sides thereof such as by further mesh material. The screens have been found effective to trap within the spaces 377 debris collected during operation of the apparatus. Preferably they are arranged to be easily removable such as by use of suitable releasable fasteners to facilitate removal of debris, or debris may simply be slipped sidewardly off the device 10 through open ended spaces 377. In alternative arrangements, the screens may be formed of material which is flexible and non resilient or may form substantially rigid cages on top of the device.

Figure 8:
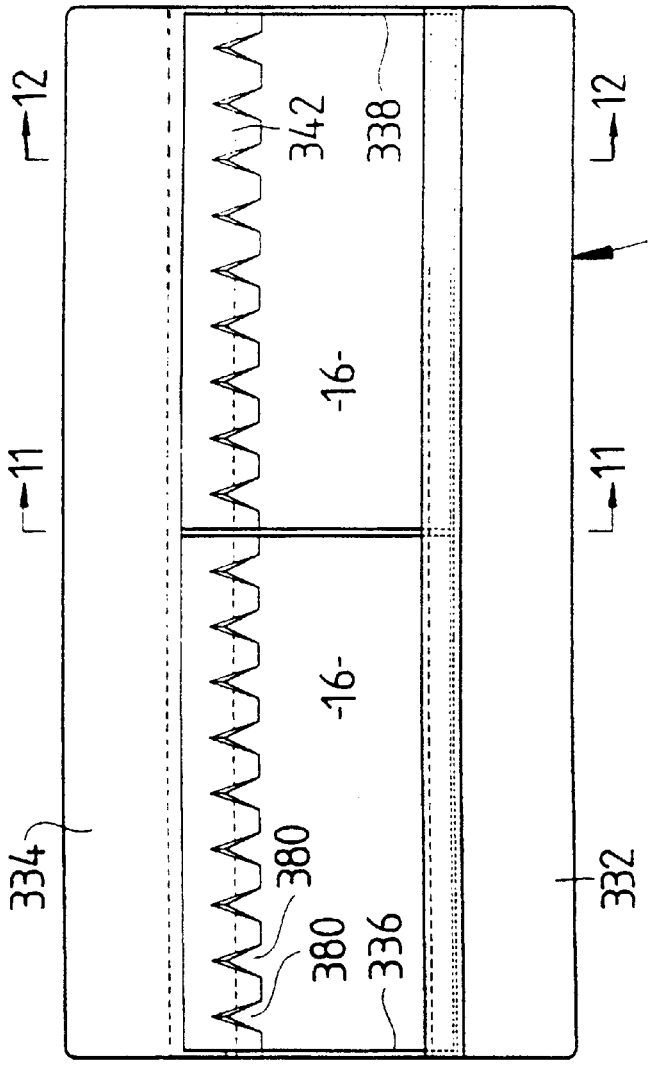
FIG. 8 is a plan view of a further embodiment of the invention.
Figure 9:
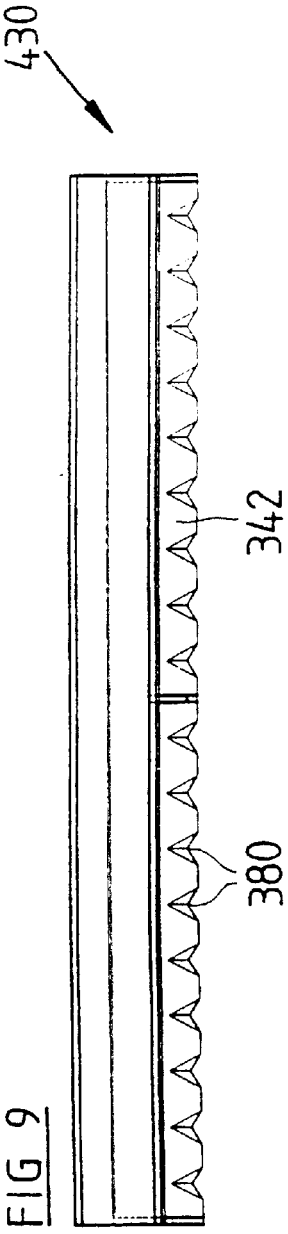
FIG. 9 is a front view of the embodiment of FIG. 8.
Figure 10:
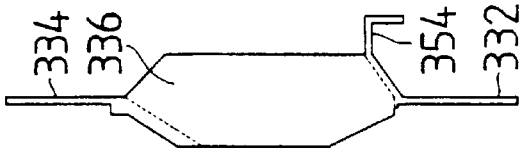
FIG. 10 is an end view of the embodiment of FIG. 8.
Figure 16:
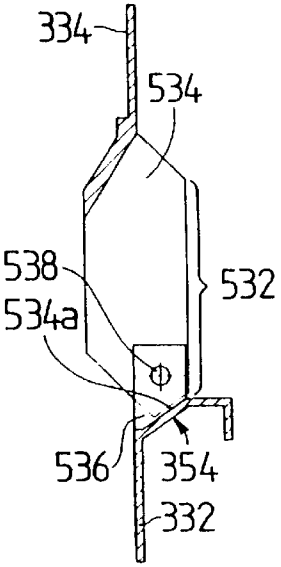
FIG. 16 is a cross section on the line 16—16 in FIG. 13.
Figure 13:
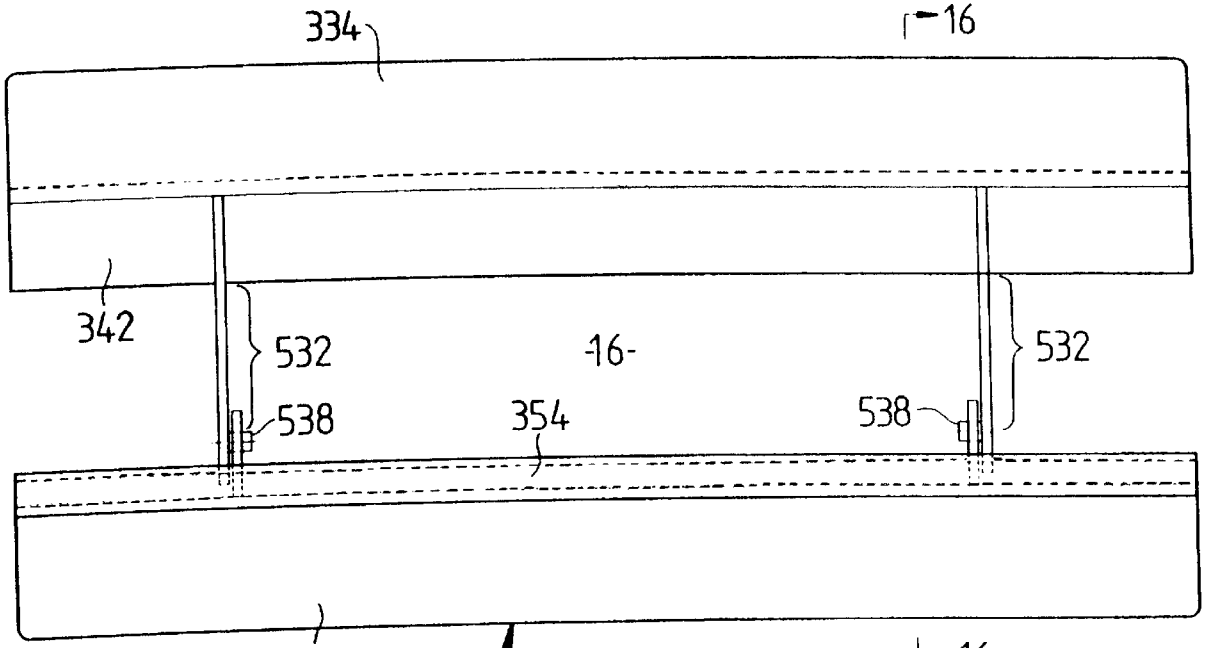
FIG. 13 is a plan view of a further embodiment of the invention.
Figure 14:
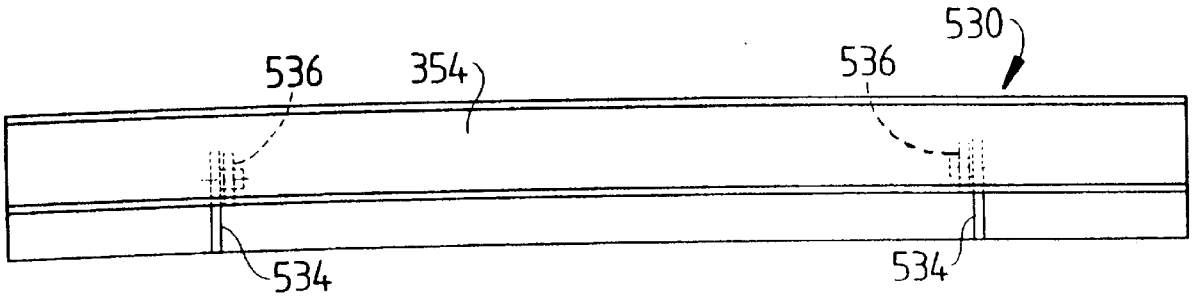
FIG. 14 is a front view of the embodiment of FIG. 13.
Figure 15:
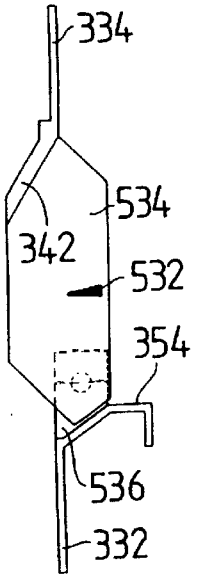
FIG. 15 is an end view of the embodiment of FIG. 13.

FIGS. 8 and 9 illustrate a modified frame 430 similar to the frame 430. In FIGS. 9 to 12, like reference numerals denote like components in FIG. 6 and 7. Here, however, the angled pick-up portions 342 are of scalloped form, being provided with V-shaped notches 380 at forward edges to facilitate the pickup of debris.

FIGS. 13 to 16 illustrate a still further modified frame 530. Again, this is generally similar to the frame 330 described in relation to FIGS. 6 and 7. Like reference numerals denote like components in FIGS. 6 & 7 and 13 to 16 and the following description is confined to differences as between frames of FIGS. 6 and 7 and of FIGS. 13 to 16.

In the frame 530, walls 336, 338 & 340 are removed, and replaced by jointed wall structures 532. Each wall structure 532 has a first portion 534 extending forwardly from the rear wall portion 334 and generally configured like the walls 338 previously described. The portions 534 terminate short of the wall portion 354 and forward portion 332 but are jointed to rearwardly extending flange portions 536 of wall structures 532 by means of pins 538. In this fashion, each wall portion 534 and the flange portion may rotate one relative to the other about the axes of the pins 538 so as to permit pivotal movement of the forward and rear parts of the frame. Thus, the strips 350 carried by these may likewise pivot about side to side axes of the device as a whole.

As shown, wall portion 354 of each frame 530 may have an upwardly and rearwardly extending portion 354*a* extending from portion 332, and the wall portion 534 may have somewhat correspondingly angled edge 534*a* which has only a relatively small clearance relative to the portion 534*a* so as to somewhat limit the amount of permitted movement as between the forward and rearwardly disposed parts of the frame 530.

The described devices have been found to be particularly satisfactory for cleaning debris from hard surfaces such as asphalt, concrete or the like, as well as from grass and similar surfaces. It has also been found satisfactory for use in collecting small items such as nuts, bolts or the like. With rough asphalt in particular, the collecting action is very efficient, the bristles 14 acting to clean the ground surface, directing debris to the upper surface of the device.

In one form of the invention, it was found satisfactory to provide openings 16 of dimensions of the order of 260 nm by 60 mn, with the depth of the pile formed by the bristles 14 being of the order of 1 cm. The sizes may however be varied as necessary to adapt the invention to particular uses. For example, the openings 16 may be of the order of 10 to 300 mm length, measured in the front to rear direction of the device of the invention. At towing speeds of up to 30 Kph, a length of about 70 mm may be satisfactory, with greater lengths being employed with faster towing speed, for example 100 mm where speeds up to 100 Kph are employed. Similarly, the depth of the pile provided by the bristles 14 may be varied. Generally, the longer the bristles, the better is the wearability, but shorter bristles are generally more efficient, since it is easier to direct objects through a lesser distance from the ground surface to the upper surface of the device. Practically, for small objects such as washers or the like a thickness of about 9 mm may be satisfactory. For large objects, greater depth may be employed. A choice of overall thickness of matting material of 5 to 15 mm will provide satisfactory pick-up of a range of commonly encountered small objects.

The bristles 14 should generally be flexible, and some degree of resilience is also desirable.

In an exemplary construction, the matting material 15 was artificial grass material formed on a base of two thicknesses of thin woven polypropylene material, the bristles 14 being formed of flat polypropylene fibres. The bristles 14 were formed from flat yarn of weight 1332 gram per square meter. The material was sewn on the backing material in loops along rows spaced apart approximately 4 mm. A rubber-like backing was then applied to the woven sheets at the side opposite the loops, and the loops cut to form the bristles as upstanding tufts. Material with 27 loops per 10 cm in each row was found to be satisfactory, the tufts being of length about 9 mm. The resultant mat-like structure is somewhat crushable by impression of hand pressure on the bristles, but has sufficient resilient to cause reasonably quick restoration to the original condition when pressure is removed. This artificial grass material is relatively flexible due to the base material (the woven material together with the rubber-like backing) being flexible.

The described artificial matting material presents an undersurface constituted by the bristles which is readily able to conform to local variations in ground surface as the device 10 is passed over the ground surface, in particular being able to conform to surface undulations as well as accommodating small obstacles, and providing an effective sweeping action to agitate debris and cause it to move through the openings 16. While it is preferred that the device include a flexible base with a conformable portion in the form of the described bristles, other constructions are possible. For example, a layer of foamed plastics material could be used. In general, the whole of the device 10 should be flexible, although, particularly if a very thick underlayer constituted by bristles, foam or other material is employed, this could be secured to a relatively rigid upper backing. In the described example of FIGS. 1 and 2, the leading edge of the device is provided with a rigid strip 25 to facilitate maintenance of the device in a spread out condition during towing over a surface.

In general, the dimension of the openings 16 in the front to rear direction of the device may be about the same or slightly greater than the front to rear distance separating adjacent openings 16, although the separation of adjacent openings 16 may be considerably greater. The device may be of any convenient dimensions. A length of the order of one meter and a width of the order of two metres may be satisfactory for general manual use.

Although the stiffening members with supporting wheels have only been specifically described in relation to the embodiment described with reference to FIGS. 6, 7 and 7*a* it will be apparent that the same features can readily be incorporated into the other described embodiments.

The described construction has been advanced merely by way of explanation, and many modifications and variations may be made thereto without departing from the spirit and scope of the invention.

What is claimed is:

1. A device for collecting debris from a surface, comprising a generally planar member having at least a portion thereof defining an undersurface of the device formed of a conformable material such that when the device is moved over a ground surface with the undersurface in contact with the ground surface the undersurface is caused to locally conform to undulations in the ground surface, the device having an opening, whereby, under said movement over a ground surface, debris on the ground surface passes through the opening onto an upper surface of the device wherein said generally planar member has forward and aft edges corresponding to the direction the device is moved over the ground surface, said edges being provided with stiffening members extending transversely to the direction the device is moved over the ground surface and said stiffening members being at least partially supported by a plurality of wheels disposed for contact with the ground surface.

2. A device as claimed in claim 1 wherein said wheels are spaced along said stiffening members.

3. A device as claimed in claim 1 or claim 2 wherein said wheels are disposed both forward and aft of at least one of said stiffening members.

4. A device as claimed in claim 3 wherein at least some of said wheels are arranged in pairs, one wheel of said pair being disposed respectively forward and aft of said stiffening member and being aligned in said direction the device is moved.

5. A device as claimed in claim 1 wherein at lease some of said wheels protrude through said planar member.

6. A device as claimed in claim 1 wherein the stiffening member at said forward edge has said wheels disposed only on the aft side.

7. A device as claimed in claim 1 wherein said wheels have a diameter not substantially greater than the thickness of said planar member.

8. A device as claimed in claim 1 wherein said portion is formed from a flexible layer.

9. A device as claimed in claim 1 wherein said portion is formed from foam plastics material.

10. A device as claimed in claim 1 wherein said portion is formed from an open mat of sinuous fibres.

11. A device as claimed in claim 1 wherein said conformable material comprises a brush-like structure.

12. A device as claimed in claim 1 wherein said conformable material comprises artificial grass formed from a flexible backing portion with flexible depending plastics filaments.

13. A device as claimed in claim 1 having entrapping means for entrapping debris passing through said opening.

14. A device as claimed in claim 1 wherein said opening is substantially surrounded by an open frame to which the conformable material is affixed.

15. A device as claimed in 14 wherein said frame is articulated so as to enable parts of the device forward and to the rear of the opening to pivot about a side to side axis.

16. A device as claimed in claim 1 having a downwardly and forwardly angled pick up portion at the rear edge of the opening.

17. A device as claimed in claim 16 wherein said pick up portion has a scalloped front edge.

18. A device as claimed in claim 1 wherein the opening extends through the conformable material.

19. A device as claimed in claim 1 wherein the opening is adjacent an edge of the conformable material.

20. A device as claimed in claim 1 wherein there are a plurality of said openings.

21. A device as claimed in claim 18 wherein said openings extend from side to side of the device.

22. A device for collecting debris from a surface, comprising a generally planar member having at least a portion thereof defining an undersurface of the device formed with depending bristles thereover and the device having an opening therethrough whereby when the device is moved over a ground surface with the bristles in contact therewith debris on the ground surface is passed through the opening to an upper surface of the device wherein said generally planar member has forward and aft edges corresponding to the direction the device is moved over the ground surface, said edges being provided with stiffening members extending transversely to the direction the device is moved over the ground surface and said stiffening members being at least partially supported by a plurality of wheels disposed for contact with the ground surface.

23. A device as claimed in claim 22 wherein said wheels are spaced along said stiffening members.

24. A device as claimed in claim 22 or claim 23 wherein said wheels are disposed both forward and aft of at least one of said stiffening members.

25. A device as claimed in claim 24 wherein at least some of said wheels are arranged in pairs, one wheel of said pair being disposed respectively forward and aft of said stiffening member and being aligned in said direction the device is moved.

26. A device as claimed in claim 22 wherein at least some of said wheels protrude through said planar member.

27. A device as claimed in claim 22 wherein the stiffening member at said forward edge has said wheels disposed only on the aft side.

28. A device as claimed in claim 22 wherein said wheels have a diameter not substantially greater than the thickness of said planar member.

29. A device as claimed in claim 22 wherein said opening has at a rear edge thereof a forwardly and downwardly depending surface to facilitate pick up of debris.

30. A device as claimed in claim 29 wherein the device is fitted at its upper surface with upstanding projections or ridges.

31. A device as claimed in claim 30 wherein an upstanding wall is formed along a front edge of the opening.

32. A device as claimed in claim 22 wherein there are a number of openings.

33. A device for collecting debris from a surface, comprising a generally planar member having an opening through the generally planar member whereby, under said movement over a ground surface, debris on the ground surface passes through the opening onto an upper surface of the device, the device having means for entrapping debris having passed through the opening wherein said generally planar member has forward and aft edges corresponding to the direction the device is moved over the ground surface, said edges being provided with stiffening members extending transversely to the direction the device is moved over the ground surface and said members being at least partially supported by a plurality of wheels disposed for contact with the ground surface.

34. A device as claimed in claim 33 wherein said wheels are spaced along said stiffening members.

35. A device as claimed in claim 33 or claim 34 wherein said wheels are disposed both forward and aft of at least one of said stiffening members.

36. A device as claimed in claim 35 wherein at least some of said wheels are arranged in pairs, one wheel of said pair being disposed respectively forward and aft of said stiffening member and being aligned in said direction the device is moved.

37. A device as claimed in claim 33 wherein at least some of said wheels protrude through said planar member.

38. A device as claimed in claim 33 wherein the stiffening member at said forward edge has said wheels disposed only on the aft side.

39. A device as claimed in claim 33 wherein said wheels have a diameter not substantially greater than the thickness of said planar member.

40. A device as claimed in claim 34 wherein the entrapping means comprises a mesh material.

41. A device as claimed in claim 40 wherein the material forming the entrapping means comprises material which forms a cavity over the upper surface of the generally planar member.

* * * * *

UNITED STATES PATENT AND TRADEMARK OFFICE

CERTIFICATE OF CORRECTION

PATENT NO. : 6,257,345 B1
DATED : July 10, 2001
INVENTOR(S) : Warwick Brook Tozer It is certified that error appears in the above-identified patent and that said Letters Patent is hereby corrected as shown below:

Title page,
Item [86], the § 371 Date "Aug. 17, 1999" should read -- Aug. 16, 1999 --.
Item [86], the § 102(e) Date "Aug. 17, 1999" should read -- Aug. 16, 1999 --.

Column 8, claim 15,
Line 20, "A device as claimed in 14" should read -- A device as claimed in claim 14 --.

Signed and Sealed this

Twenty-sixth Day of March, 2002

*Attest:*

*Attesting Officer*

JAMES E. ROGAN
*Director of the United States Patent and Trademark Office*